United States Patent [19]

Park et al.

[11] Patent Number: 4,579,023

[45] Date of Patent: Apr. 1, 1986

[54] OPEN END WRENCH

[76] Inventors: Sea C. Park; In P. Park, both of 3836 Birchwood, Skokie, Ill. 60076

[21] Appl. No.: 664,029

[22] Filed: Oct. 23, 1984

[51] Int. Cl.[4] ..... B25B 7/12

[52] U.S. Cl. ..... 81/383.5

[58] Field of Search ..... 81/342, 349, 350, 351, 81/355, 361, 367, 374–380, 383.5

[56] References Cited

U.S. PATENT DOCUMENTS

| | | | |
|---|---|---|---|
| 2,564,585 | 8/1951 | Shaw | 81/383.5 |
| 2,619,138 | 11/1952 | Marler | 81/342 |
| 2,822,715 | 2/1958 | Raimondi | 81/383.5 |
| 2,910,903 | 11/1959 | Rains | 81/383.5 |

FOREIGN PATENT DOCUMENTS

| | | | |
|---|---|---|---|
| 329571 | 9/1935 | Italy | 81/383.5 |

*Primary Examiner*—James L. Jones, Jr.

*Attorney, Agent, or Firm*—Birch, Stewart, Kolasch & Birch

[57] ABSTRACT

A wrench comprising an upper jaw member and a lower jaw member, the lower jaw member extending into an upper arm member, the upper jaw member being pivotally connected to the lower jaw member, a biasing spring operatively associated with the upper and lower jaw members for biasing the jaws in an open position, an intermediate arm member pivotally connected to said upper arm member at the rear end portions thereof, the intermediate arm member being provided at the front end portion thereof with an inclined surface which is adapted to slidably engage the rear surface of the upper jaw member, and lower handle member pivotally connected with the intermediate arm member and the upper arm member, whereby when the lower handle member is compressed toward the intermediate arm member, the inclined surface of the front end portion of the intermediate arm member is caused to ride along the rear portion of the upper jaw member, forcing the upper jaw member to close toward the lower jaw member.

3 Claims, 5 Drawing Figures

20
19
13
C
C
10'
21
12
25
15
14
B
B
A
A
L2
L1
29
28
27
26
17
16
11
10
11
10
16
17
18

OPEN END WRENCH

BACKGROUND AND SUMMARY OF THE INVENTION

The present invention relates generally to a specialized type of wrench, and more particularly, to a wrench which is very easy to operate, thereby faciliating its use in small, hard to reach areas.

There are many types of wrenches which are well known in the art as exemplified by U.S. Pat. No. 415,923 to Painter, U.S. Pat. No. 2,537,175 to Viets, U.S. Pat. No. 3,299,725 to Gewirc et al and U.S. Pat. No. 3,448,641 to Morrow. However, these wrenches suffer from a number of difficulties such as, for example, they are complicated in structure, expensive to manufacture, and, in many cases, are difficult to operate in that several different operational steps are required to apply pressure, retain pressure and release the pressure from the object to which the wrench is being applied.

Accordingly, it is an object of the present invention to provide an improved wrench in which the wrench jaws are maintained in an initial open position.

Another object of the present invention is to provide a wrench which has jaws which are spring biased in an ope position and which are rotatably disposed to close on each other along an eccentric surface.

A further object of the present invention is to provide an improved wrench which exerts a high degree of force with a reduced amount of exertion by the user.

Still another object of the present invention is to provide an improved wrench which automatically increases its grasping power as the wrench is operated.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention provides an improved wrench which is inexpensive and simple to manufacture, easy to operate and contains the added feature of reactively increasing its tightening or grasping power as the wrench is applied to an object.

BRIEF DESCRIPTION OF THE DRAWINGS

The present invention will become more fully understood from the detailed description given hereinbelow and the accompanying drawings which are given by way of illustration only, and thus are not limitative of present invention, and wherein.

DETAILED DESCRIPTION OF THE INVENTION

Figures 1, 3:
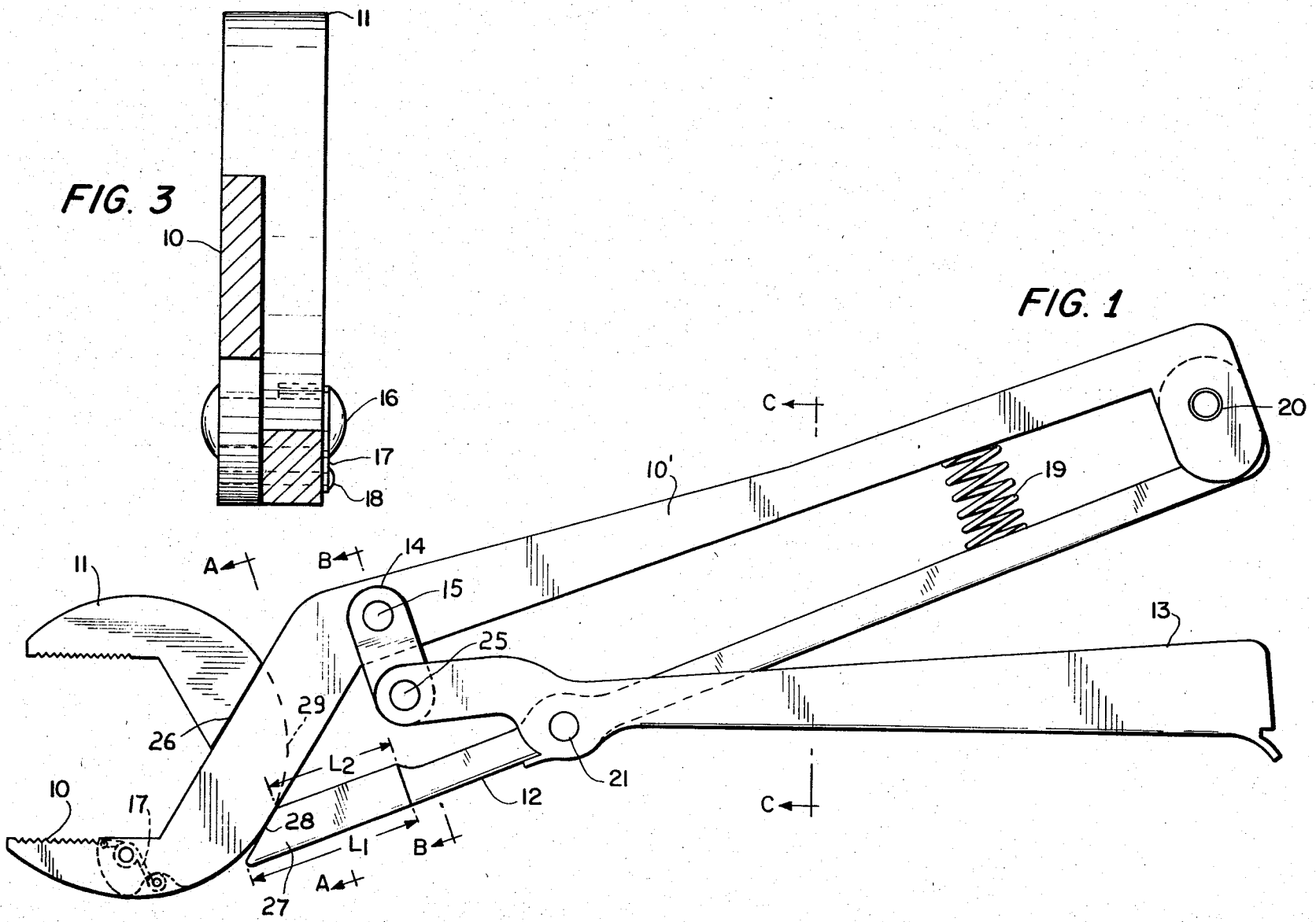
FIG. 1 is a side view of the wrench of the present invention.
FIG. 3 is an enlarged section taken along line A—A of FIG. 1.

Referring now in detail to the drawings for the purpose of illustrating the present invention, the wrench of the present invention as shown in FIG. 1 comprises jaws 10 and 11 having teeth on the inside thereof, a pivot pin 16 connecting the jaws 10 and 11 together with the jaw 10 extending into an arm member 10', a lower handle member 13 and intermediate arm member 12. The jaw member 11 is connected with the jaw member 10 utilizing a spring member 17 and a pin 18 which biases the jaw member in an open position. Thus the retaining spring member 17 is connected by stud member 22 to hole 23 of jaw member 11 and secured at the other end thereof by pin 18 which is secured in hole 24 of jaw member 10. Thus the retaining spring 17 holds the jaws 10 and 11 in an open position since the force of the retaining spring is constantly acting against the end of the jaw 11 at the pivot pin 16. The surface 26 of the jaw member 11 abuts against a corresponding surface on jaw member 10 thereby establishing a maximum open position of the jaw members.

The intermediate arm member 12 is pivotally connected to arm member 10' through pivot point 20 and is held in a biased position apart from arm member 10' by spring 19. The lower handle member 13 is pivotally connected to intermediate arm member 12 at pivot point 21 and is further pivotally connected to arm member 10' at the pivot points 15 and 25 of hinge member 14. The intermediate arm member 12 is provided with an end portion 27 which has an inclined surface 28 which is adapted to slidably engage the rear surface 29 of the jaw member 11. The inclined surface 28 is established by dimensioning the end portion of the intermediate arm member 12 so that $L_1$ is a longer dimension than $L_2$ as shown in FIG. 1. Intermediate arm member 12 is thicker than the front end portion 27 to provide additional strength. Front end section 27 is necessarily reduced in its thickness so that it can effectively engage the rear portion 29 of the jaw member 11.

In operation, as the lower handle member 13 is compressed toward the intermediate arm member 12, the intermediate arm member 12 is compressed toward arm member 10 against the bias of spring 19 thereby causing the inclined surface 28 to ride along the rear portion 29 of the upper jaw member 11. Thus, as force is applied to the lower handle member 13, the front end portion 28 of the intermediate arm member 12 forces the upper jaw member 11 to rotate around pivot points 16 against the bias of spring 17 thereby forcing the upper jaw member 11 to close on the lower jaw member 10. The upper jaw member 11 closes on the lower jaw member 10 in both a downward and inward direction. Furthermore, when the handles 12 and 13 are rotated in a clockwise direction the force applied between the inclined surface 28 of the intermediate arm 12 and the rear portion 29 of the upper jaw member 11 actually causes the jaws 11 and 10 to hold tighter to the object to which the wrench is being applied because of the differences in the dimension of $L_1$ and $L_2$ as shown in FIG. 1 of the present application.

Figure 2:
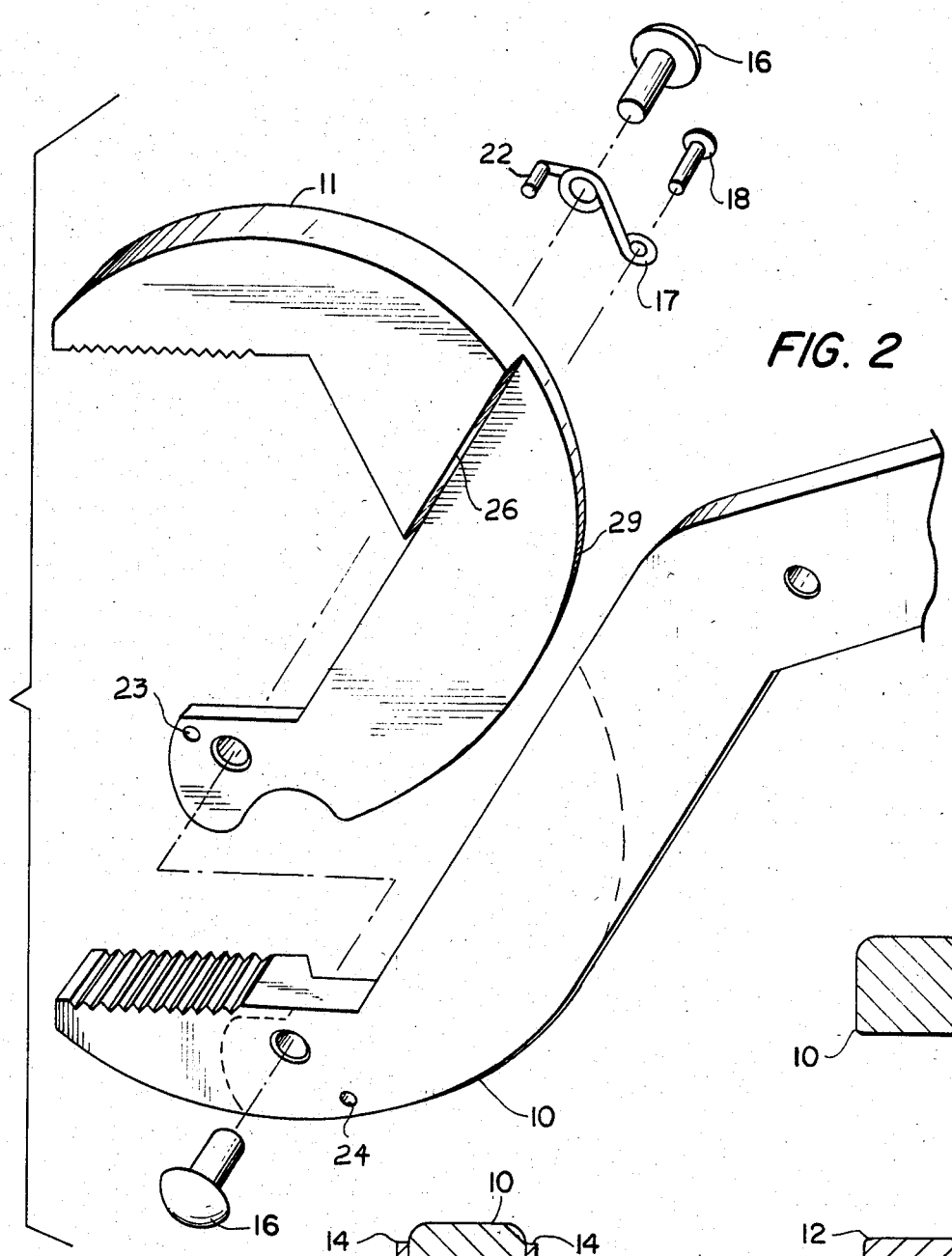
FIG. 2 is an exploded perspective view showing the jaws of the wrench according to the present invention.
Figure 4:
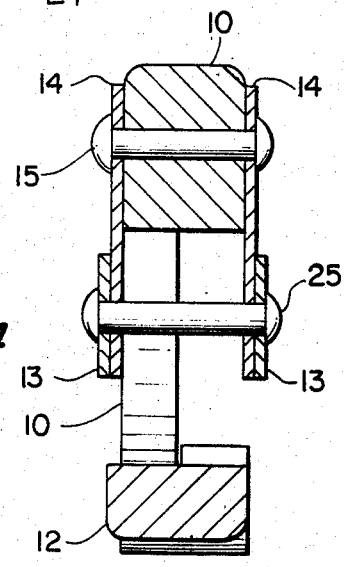
FIG. 4 is an enlarged section taken along line B—B of FIG. 1.
Figure 5:
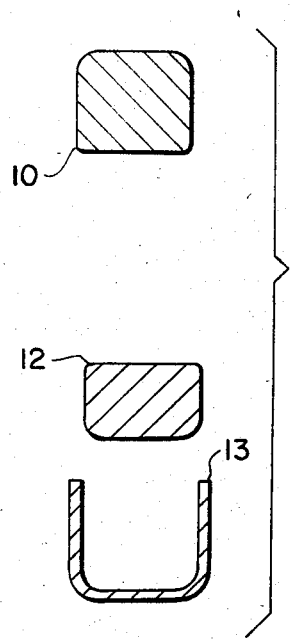
FIG. 5 is an enlarged section taken along line C—C of FIG. 1.

FIG. 2 is an exploded perspective view showing the upper and lower jaw arrangement of the wrench of the present invention. FIGS. 3, 4 and 5 show enlarged cross-sectional views along the section lines shown in FIG. 1. From the above description, it can be understood that the wrench of the present invention in its initial operating position is always ready for application to a particular object since its jaws 10 and 11 are in a spring bias open position. Accordingly, it is only necessary to squeeze handles 12 and 13 toward the upper arm member 10' to selectively control the distance between the upper and lower jaws 11 and 10. Thus, an infinite number of grasping positions can be achieved by merely controlling the extent to which handles 12 and 13 are compressed toward upper arm member 10'. Also, because of the interaction between the sliding surface 28 and the rear surface 29 of the upper jaw member 11, the wrench of the present invention can be operated with a maximum grasping power requiring little squeezing effort.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A wrench comprising an upper jaw member and a lower jaw member, said lower jaw member extending into an upper arm member, said upper jaw member being pivotally connected to said lower jaw member, spring biasing means operatively associated with said upper and lower jaw members for biasing said jaws in an open position, an intermediate arm member pivotally connected to said upper arm member at the rear end portions thereof, said intermediate arm member being provided at the front end portion thereof with an inclined surface which is adapted to slidably engage the rear surface of said upper jaw member, and lower handle member pivotally connected with said intermediate arm member and said upper arm member, whereby when said lower handle member is compressed toward the intermediate arm member, the inclined surface of the front end portion of the intermediate arm member is caused to ride along the rear portion of the upper jaw member, forcing the upper jaw member to close toward the lower jaw member.

2. The wrench of claim 1 wherein a spring means is disposed between the upper arm member and the intermediate arm member for biasing the intermediate arm member away from the upper arm member.

3. The wrench of claim 1 wherein the inclined surface has its larger dimension at the bottom and its smaller dimension at the top of said front end portion of the intermediate arm member.

* * * * *